US005727300A

United States Patent [19]

Ekdahl et al.

[11] Patent Number: 5,727,300

[45] Date of Patent: Mar. 17, 1998

[54] FASTENER VERIFICATION SYSTEM

[75] Inventors: Michael S. Ekdahl, Salem, Oreg.; John Thomas Hanks, Bellevue; Kirk Brenden Hiller, Renton, both of Wash.; Joseph G. LaChapelle, Corvallis, Oreg.; Kirk Vaughn Thomas, Kent, Wash.; Mark S. Turley, Albany, Oreg.

[73] Assignee: The Boeing Company, Seattle, Wash.

[21] Appl. No.: 386,364

[22] Filed: Feb. 7, 1995

[51] Int. Cl.[6] ..... B23Q 17/00

[52] U.S. Cl. ..... 29/407.04; 29/702; 29/715

[58] Field of Search ..... 29/407.04, 525.01, 29/525.02, 525.06, 702, 703, 707, 714, 715, 243.53; 227/6, 7, 119; 356/375, 394; 382/141, 152

[56] References Cited

U.S. PATENT DOCUMENTS

| | | | |
|---|---|---|---|
| 3,700,139 | 10/1972 | Kelly | 221/241 |
| 3,749,830 | 7/1973 | Blitchington, Jr. . | |
| 4,048,687 | 9/1977 | Kato et al. | 29/714 |
| 4,180,195 | 12/1979 | Caley et al. . | |
| 4,240,691 | 12/1980 | Holmqvist et al. | 359/509 |
| 4,295,198 | 10/1981 | Copeland et al. . | |
| 4,379,308 | 4/1983 | Kosmowski et al. . | |
| 4,481,533 | 11/1984 | Alzmann et al. . | |
| 4,555,798 | 11/1985 | Broadbent, Jr. et al. . | |
| 4,568,971 | 2/1986 | Alzmann et al. . | |
| 4,577,794 | 3/1986 | Armstrong et al. . | |
| 4,596,037 | 6/1986 | Bouchard et al. . | |
| 4,645,112 | 2/1987 | Davern et al. . | |
| 4,647,208 | 3/1987 | Bieman . | |
| 4,658,113 | 4/1987 | Vingerling | 219/147 |
| 4,753,013 | 6/1988 | Shemeta . | |
| 4,797,939 | 1/1989 | Hoki et al. . | |
| 4,799,175 | 1/1989 | Sano et al. . | |
| 4,807,296 | 2/1989 | Ando et al. . | |
| 4,823,396 | 4/1989 | Thompson . | |
| 4,828,159 | 5/1989 | Woods . | |
| 4,866,629 | 9/1989 | Chen et al. . | |
| 5,150,623 | 9/1992 | Woods | 73/865.8 |
| 5,539,977 | 7/1996 | Kano et al. | 29/714 |

FOREIGN PATENT DOCUMENTS

| | | | |
|---|---|---|---|
| 192646 | 11/1983 | Japan | 29/243.53 |
| 231546 | 11/1985 | Japan | 29/407 |

*Primary Examiner*—David P. Bryant
*Attorney, Agent, or Firm*—Lawrence W. Nelson; Michael J. Neary

[57] ABSTRACT

An automatic fastener installation machine feeds fasteners to a fastener inserter and senses the orientation and size of the fastener in the fastener inserter prior to inserting the fastener into a fastener hole in a work piece to determine whether the proper sized fastener is properly oriented in the fastener inserter. A support structure holds the work piece in position under the fastener inserter and the machine moves to the next fastener insert position while a fastener feeder delivers a fastener to a fastener holder. A vision system creates an image of the fastener in the fastener holder and compares predetermined points in the image with corresponding predetermined points that would be produced by the vision system of an image of a properly sized and oriented fastener in the holder, and produces a signal for the automatic fastener installation machine to proceed with its cycle when it determines that a fastener of the correct size is positioned correctly in the holder.

22 Claims, 11 Drawing Sheets

FASTENER VERIFICATION SYSTEM

This invention relates to automated fastener installation systems, and more particularly to systems for verifying that the correct fastener is ready for installation in a work piece, and that it is oriented correctly for installation in the work piece.

BACKGROUND OF THE INVENTION

High volume fastening machines used for large structures such as airplane wings for commercial transports are designed to operate rapidly and precisely, which is a practical necessity considering that a fastener is inserted about every 1.5 inches in multiple rows along the entire length of the wing, which in a medium sized airplane can extend about 50 feet long. The operation, even with modern high speed equipment, is very labor intensive and time consuming.

The necessity for speed has resulted in some time consuming and costly production problems. If a rivet is fed to the rivet hole in a cocked or inverted position and the ram is not halted in time, it can damage the wing panel. There have been instances in which the damage was so severe that it was necessary to scrap the entire wing panel, an enormously costly event. Other problems include a rivet of the wrong length or diameter in the rivet feeder. A wrong size rivet will ordinarily not damage the wing panel, but must be drilled out and replaced with a correctly sized rivet before the wing panel can be used to build up the wing. The wasted time and cost of such errors demonstrates the need for a system that can examine the orientation and size of a rivet while in the rivet holder before it is inserted into the rivet hole.

These same considerations apply with equal or more force to the insertion of threaded fasteners in wing panels and other large structures that are fastened by automated equipment. Threaded fasteners used in the aerospace industry include conventional helically threaded fasteners that engage a threaded nut, and lock bolts that have circular threads gripped by a swaged collar. They are usually high strength materials, including titanium alloys, and they are harder and stronger than the aluminum structures they are used in. When such a fastener is fed by an automatic fastener insertion machine in a cocked or inverted position, the likelihood of damage is even greater than when aluminum rivets are used. If anything, the need for a fastener size and position sensor is even greater for threaded fasteners than it is for rivets.

The problem has existed for many years and numerous attempts have been made to solve the problem. A fastener scanning system, shown in U.S. Pat. No. 4,823,396, was developed to scan fasteners on route to the fastener insert device to ensure that the fastener is the correct size and oriented correctly, that is, tail first. This did not solve the problem of cocked fasteners held in the fastener holder being crushed at a cocked angle into the panel. Moreover, the rivets used in some airplane wings are so called "ice box rivets" which must be kept at a low temperature until they are upset. The low temperature of such ice box rivets could cause fogging or frosting of the viewing glass in the '396 patent and interfere with the image of the fastener.

A light-interrupt system is used on some riveting machines to confirm that a rivet is held in the rivet holder before the machine is operated to press the rivet into the rivet hole to prevent damage to the panel by the ram when no rivet is present. This light interrupt system does not detect cocked or inverted rivets, nor can it distinguish between correctly sized and incorrectly sized rivets.

Experienced operators can often sense when a cocked fastener is being pressed against the panel, and can often stop the machine before extensive damage is done. The operator perceives sound and vibration from the operation of the machine in the feeding of a cocked rivet which tells him that the rivet squeezing operation is not normal, so he can halt the ram motion before the panel has been ruined. However, there is some reaction time before the operator can act, and the operator may be distracted at the moment with some of the other tasks in operation of the machine, so damage occurs occasionally even with attentive operators.

Image processing systems are know for circuit board terminal examination and hole location checks, and other such applications. Indeed, a camera is used on some automatic riveting machines to view the rivet after upsetting and shaving to give the operator real time information about the process so he can correct it if the results begin to appear unsatisfactory. However, the use of an image processing system in the inner mechanisms of an automatic fastener installation machine presents special problems that have deterred those skilled in the art from successfully applying the image processing technology to this application. The environment is extremely cluttered with a tangle of tubes, wires, and moving mechanisms of many kinds, and this makes it nearly impossible for the image processing system to discern the fastener from the background. Lights placed to illuminate the machine, the panel and the controls can interfere with the operation of the image processing system. Lubricants and cutting fluids in use in the machine can become airborne as aerosols and can coat the camera of an image processing system to blur the image it creates. The machine must often be adjusted and a camera in the heart of the machine, especially an existing machine into which the camera is to be retrofitted, can interfere with adjustment or replacement of mechanisms in the normal course of operation.

Accordingly, there has long been a need in the art, and particularly in the aircraft industry, for a fastener inspection system that could examine a fastener, in real time, after it is injected into a fastener holder in preparation for insertion into a hole to be drilled into a wing panel or other work piece, and accurately and reliably determine if the fastener is the correct size and is oriented properly, that is, held vertically centered in the holder with the head up. The system should serve as a quality control tool to anticipate when problems in the process are beginning to develop so that the problem can be corrected before it interferes with quality or the production rate, and also facilitate the compilation of a record to demonstrate to management, to the customer, and to government authorities that the process is functioning properly as designed.

SUMMARY OF THE INVENTION

Accordingly, it is an object of this invention to provide an improved method of examining a fastener in an automatic fastener installation machine to ensure that only properly sized and oriented fasteners are being installed, so that tipped, inverted or incorrectly sized fasteners will be rejected before installation. Another object of this invention is to provide an improved method for operating an automatic fastener installation machine that incorporates a fastener size and orientation check while allowing the installation rate to be as fast or faster than the rate was without the fastener checking step. Yet another object of this invention is to provide an image processing system for examining the orientation and size of a fastener held in a fastener holder of an automatic fastener installation machine and comparing it with the size of the fastener designated for insertion at that location in the work piece, and for preventing insertion of any fastener that is the wrong size or wrongly orientation. Still another object of this invention is to provide an image processing system, for examining the size and orientation of a fastener in a fastener holder, that can operate reliably in a hostile, dirty, cluttered and visually noisy environment existing in the heart of an automatic fastener installation machine.

These and other objects of the invention are attained in an image processing system having a pair of cameras aimed at the ejector end of a fastener feed mechanism where the feed mechanism injects a fastener into a fastener holder. Two back lights are supported opposite the cameras on the other side of the fastener holder and illuminate the fastener in the fastener holder with a uniform back light through a blank white diffuser on each back light to facilitate the generation of a clean sharp silhouette image by the cameras. The image is measured along a series of horizontal gauge lines and along a vertical gauge line along the centerline of the fastener by detecting edges of the fastener, that is, where the light changes from light to dark in the course of a few pixels at one edge, and then back to light again at the other edge. Those measurements, taken in the form of pixels and converted to length measurements by the image processing system processor, are transmitted to the system controller and compared with the dimensions of a correctly sized and oriented fastener held in that fastener holder. If the dimensions correspond within a certain range of tolerance, the machine is enabled to proceed with the machine cycle. If the dimensions do not correspond, the operator is notified by a message on his monitor and he can operate the appropriate control to feed a correctly sized fastener into the holder, pushing the incorrectly sized or oriented fastener out.

DESCRIPTION OF THE DRAWINGS

The invention, and its many attendant objects and advantages, will become more clear upon reading the description of the preferred embodiment in conjunction with the following drawings, wherein.

DESCRIPTION OF THE PREFERRED EMBODIMENT

Figure 1:
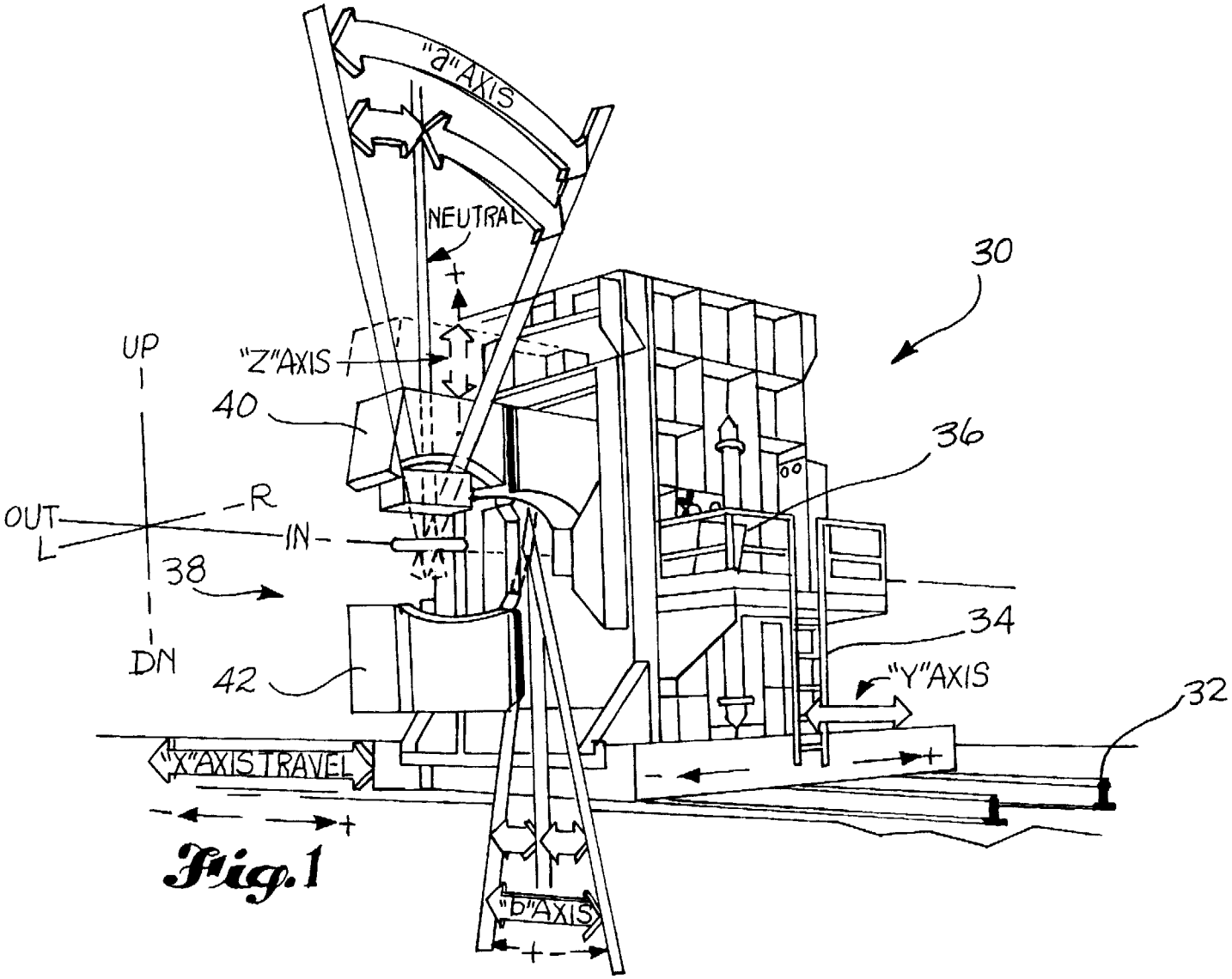
FIG. 1 is a perspective view of a representative fastener installation machine on which the image processing system of this invention is mounted.

Turning now to the drawings wherein like reference characters designate identical or corresponding parts, and more particularly to FIG. 1 thereof, an automatic fastener installation machine 30 is shown mounted on tracks 32 for movement along an X-axis of travel. Machine includes a ladder 34 by which an operator may ascend to one or more operating positions, one of which is shown at 36. The machine 30 supports a large C frame 38 having an upper head 40 and a lower head 42 projecting perpendicular to the X access of travel and spanning a work zone in which a work piece such as an airplane wing skin is supported horizontally on a series of spaced supports (not shown). A description of the invention will use the orientation of the machine in FIG. 1 for reference although obviously the invention could be used in other orientations and is not dependent on the orientation shown in FIG. 1.

Figure 2:
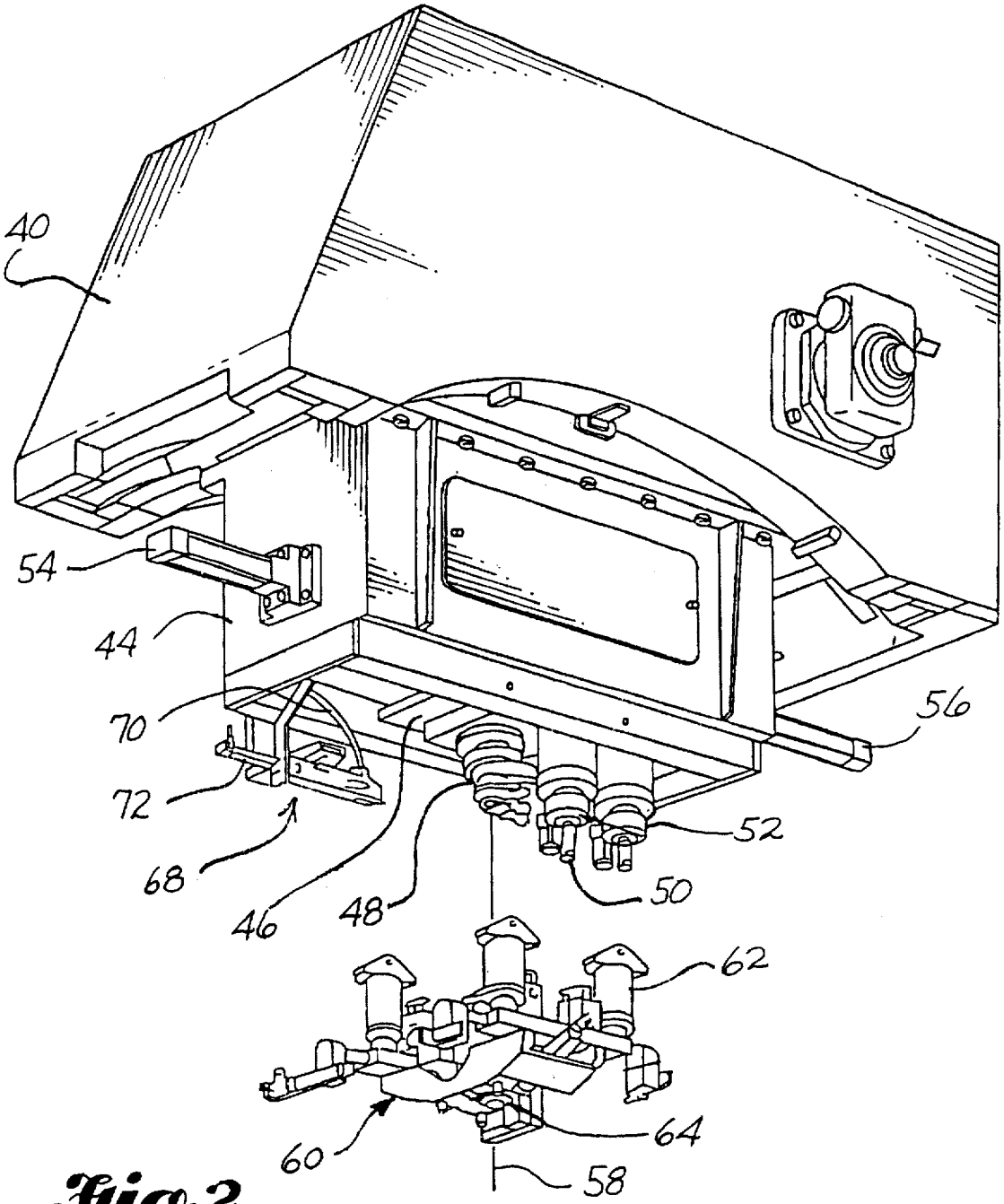
FIG. 2 is a perspective view of the upper head of the fastener installation machine shown in FIG. 1, showing the fastener injector aligned with the moving tool shuttle, and showing the pressure foot assembly exploded away for clarity of illustration.
Figure 3:
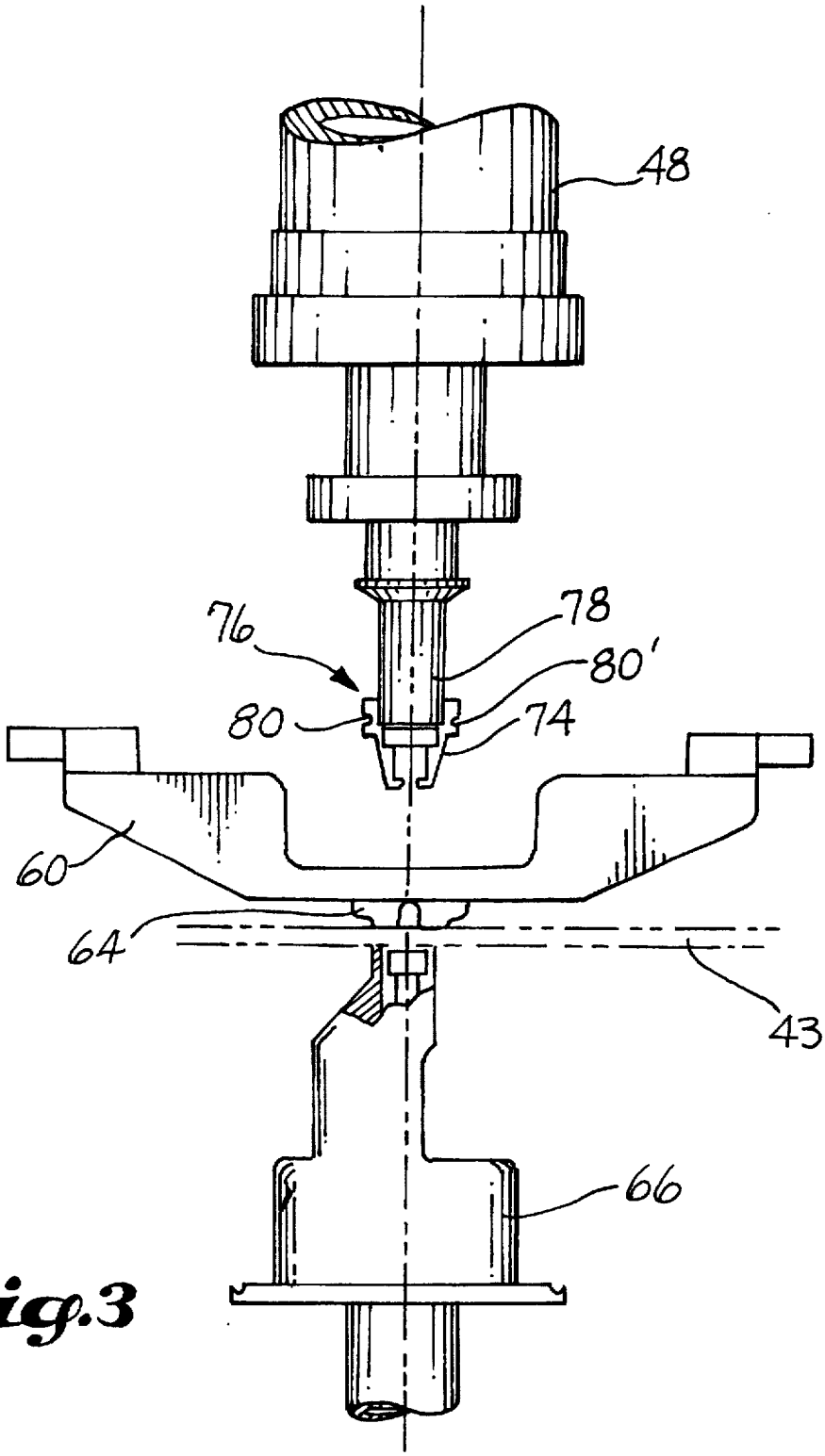
FIG. 3 is an enlarged view of the fastener holder and ram aligned with the pressure foot in the machine shown in FIG. 1, with the fastener holder shown without a fastener for clarity of illustration.
Figure 5:
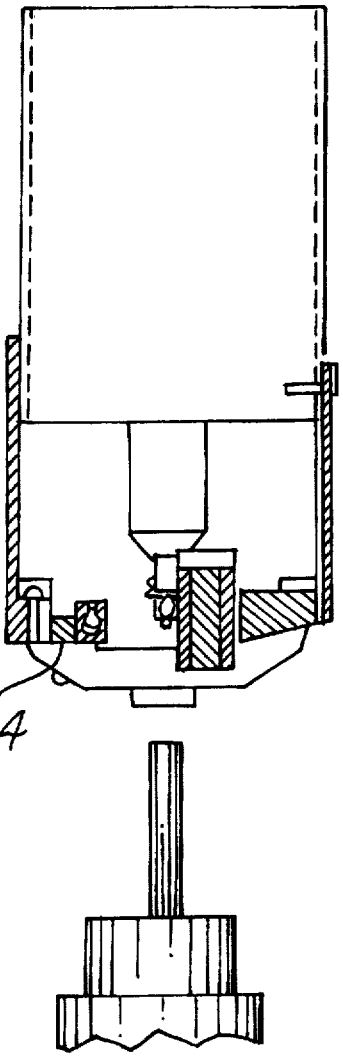
FIG. 5 is a schematic end elevation of the fastener installation machine shown in FIG. 4, showing the lights of the invention aimed at the fastener holder of the machine, and showing the camera brackets on the opposite side of the machine, but omitting the camera for clarity of illustration.

The upper head 40 includes a transfer head 44 mounted for swiveling through an arc shown in FIG. 1 as the "A-axis". This swivel enables the tools on the transfers head 42 to be presented normal to the curved surface of the wing skin along the line of rivets being installed by the machine 30. A tool shuttle 46 is mounted for linear movement along the X-axis in the transfer box 44 and supports three tools shown in FIG. 2, namely a ram 48, a shaved spindle 50, and a drill spindle 52. The position of the tool shuttle 46 is controlled by a pair of pneumatic cylinders 54 and 56 by which the three tools on the tool shuttle 46 can be positioned in order in fine with the center line 58 through a opening in a pressure foot 60. The pressure foot is mounted on the transfer box 44 by hydraulic cylinders 62 so that it can raise and lower the pressure foot 60 to press a pressure foot bushing 64 against the wing skin. Simultaneously a corresponding ram on the lower head 42 ascends to press a stringer against the underside of a wing skin and this clamp arrangement between the upper and lower heads 40 and 42 is maintained during operation of the tools.

A rivet injector 68 is mounted on the transfer box 44 axially lined along the Y-axis with the ram 48. The rivet injector 68 receives rivets from a pneumatic feed system connected to a tube 70 which delivers the rivet in a head up position to the inner end of the rivet injector 68. A pneumatic cylinder 72 on the rivet injector 68 operates a rivet ram (not shown) in the rivet injector 68 to push the rivet out of the rivet injector 68 and in between a pair of rivet fingers 74 of a rivet holder 76. The rivet fingers 74 are mounted in opposed slots in a cylindrical anvil 78 mounted at the lower end of the ram 48. The rivet fingers 74 are spring bias toward one another by a spring loaded caliber (not shown) which engages the rivet fingers 74 at opposed recesses 80 at the top of the rivet fingers 74.

When the tool shuttle 46 is in its left most position with the inner end of the rivet injector 68 positioned to inject a rivet into the rivet fingers 74, the drill spindle 52 is aligned with the center line 58 through the pressure foot 60 and the machine is in positioned to drill a hole for injection of the rivet. The next step would be for the shuttle 46 to travel to its extreme right hand position illustrated in FIG. 2 and for the ram 48 to descend to push the anvil 78 against the head of the rivet to drive it into the hole drilled by the spindle 52. However, occasionally the rivet injector 68 injects a rivet so that it is caught and held by the fingers 74 in a non vertical or inverted position, or occasionally stacked rivets may be fed between the fingers in the same feed operation. In any of these events, that is, whenever a single rivet is not fed to the fingers 74 and held vertically centered between the fingers, the force exerted by the ram 48 on the anvil 78 could force a wrongly position rivet against the top of the wing skin which could cause damage to the wing skin. The damage is occasionally severe enough that the wing skin can not be repaired and must be scrapped, at an enormous cost.

Figure 4:
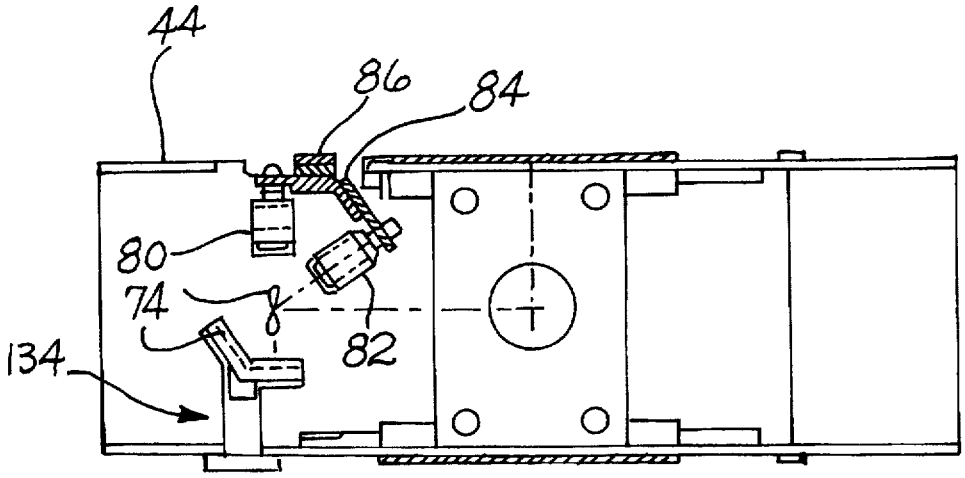
FIG. 4 is a schematic plan view of the lights and camera of the invention, shown aimed at a fastener holder of the fastener installation machine shown in FIG. 1.
Figure 6B:
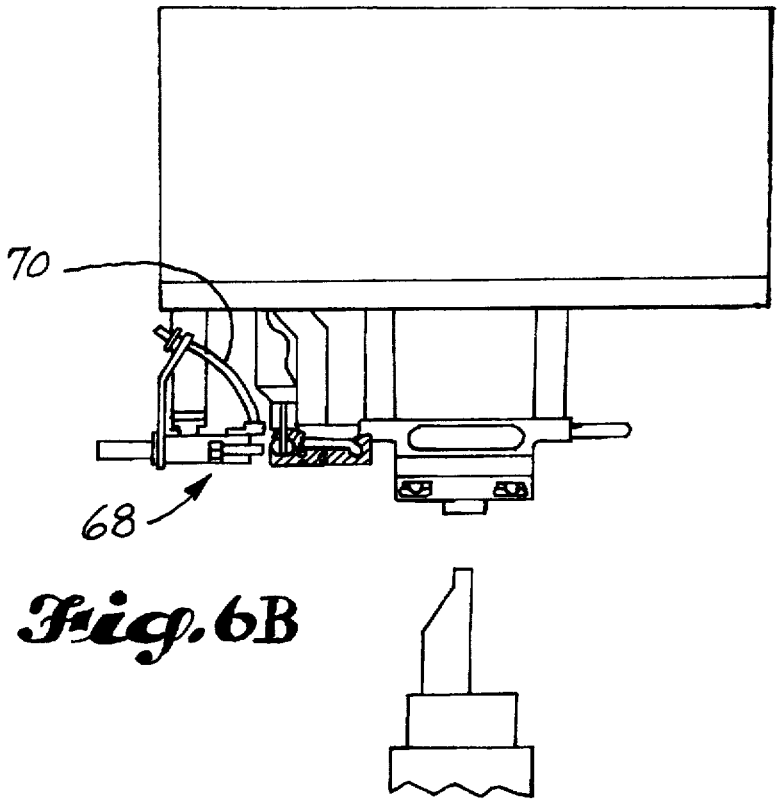
FIGS. 6A and 6B are schematic side elevations of the structure shown in FIG. 5.
Figure 6A:
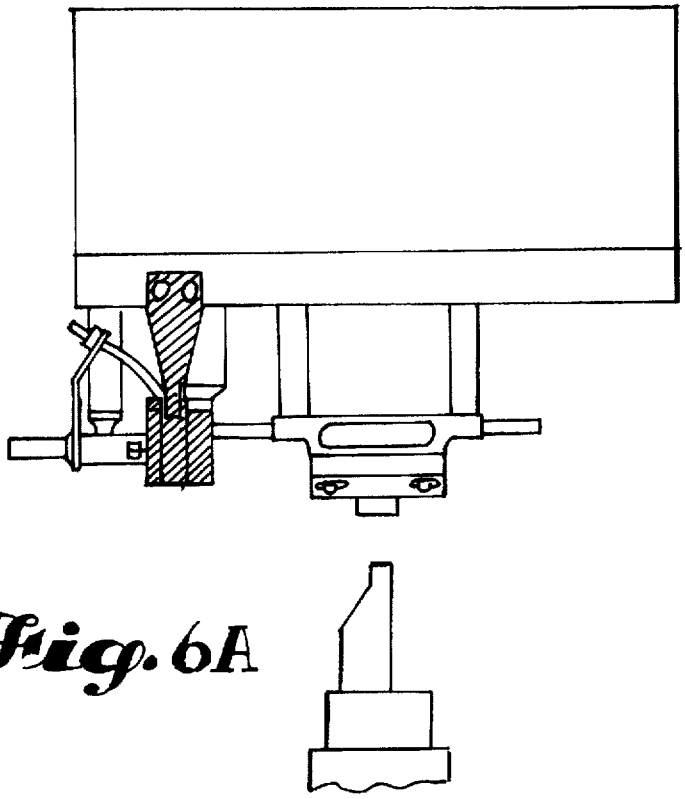
Figure 7:
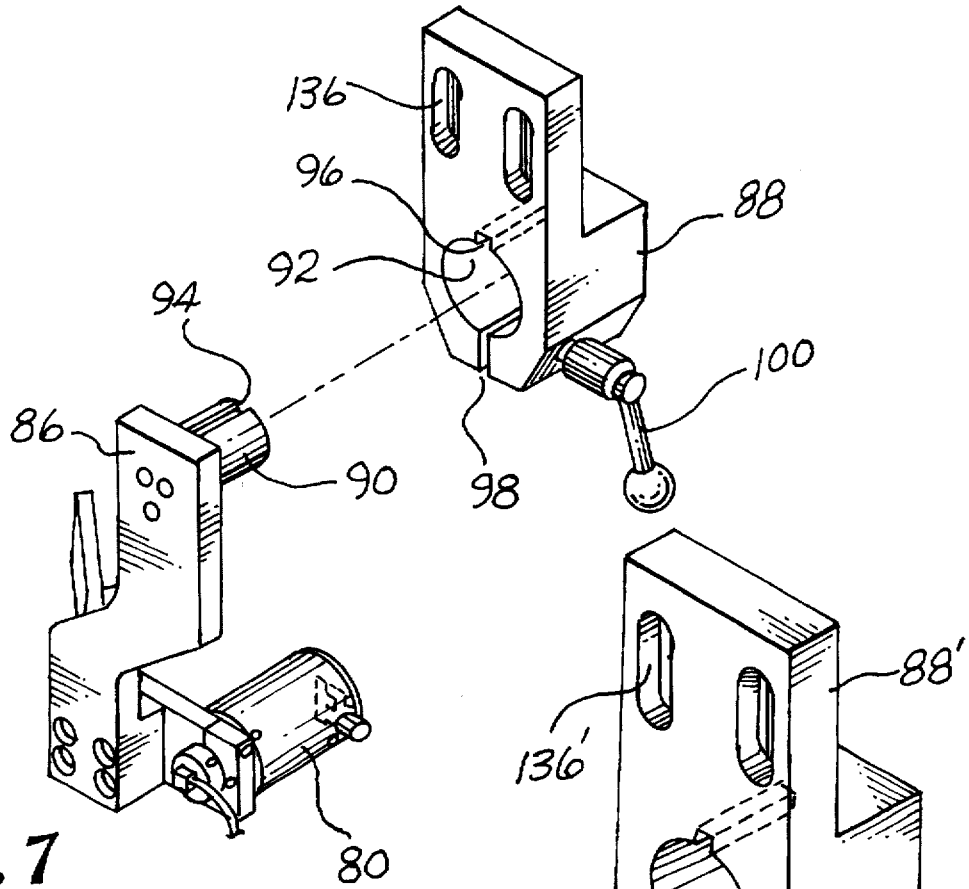
FIG. 7 is an exploded view of the camera ands camera mounting and support brackets, illustrating the structure used to mount the camera in the machine shown in FIG. 1.
Figure 8:
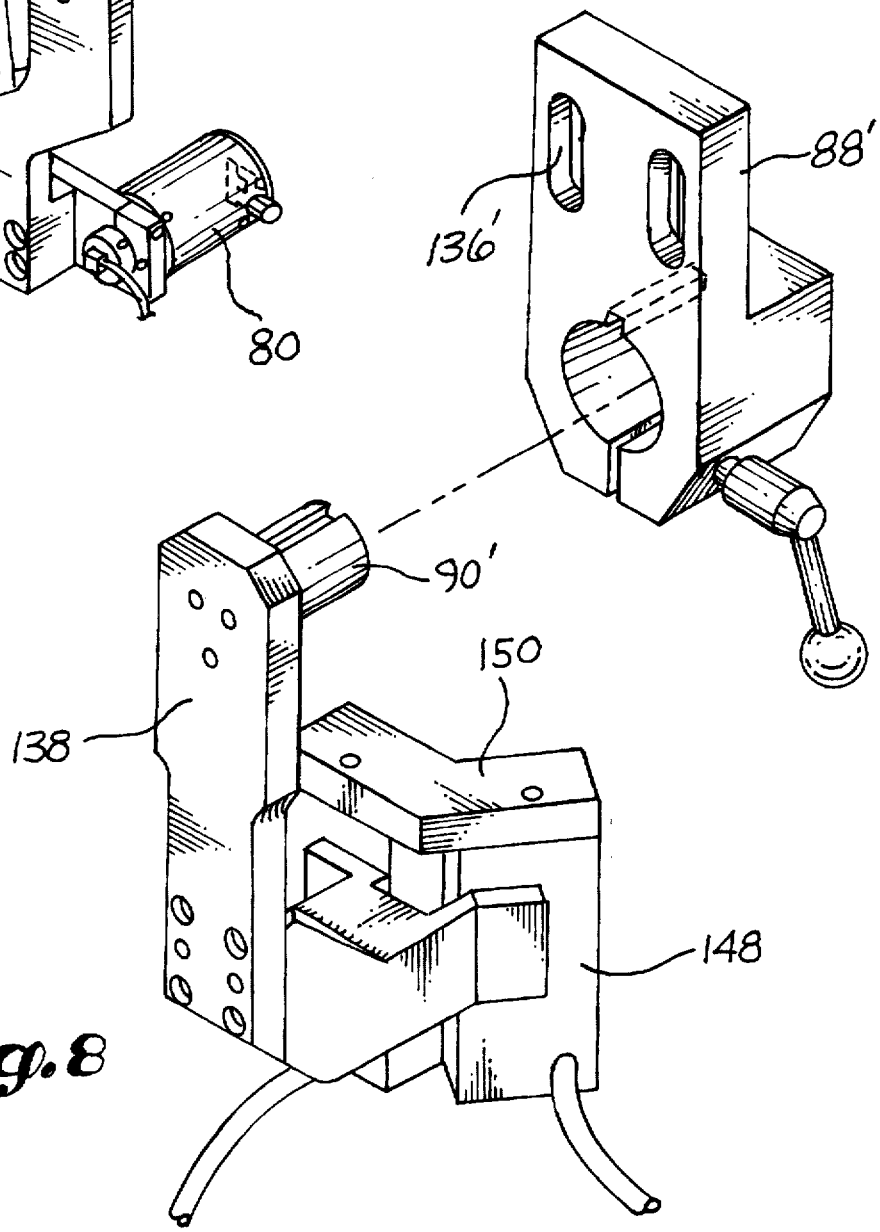
FIG. 8 is an exploded view of the lights and light mounting and support brackets, illustrating the structure used to mount the lights in the machine shown in FIG. 1.

To ensure that a single rivet of the correct dimensions is held properly oriented in the fingers 74 before operation of the ram to push the rivet into a hole drilled by the spindle 52, an image processing system is provided to create an image of the rivet held in the fingers 74, and those images are analyzed and compared with data corresponding to a correctly sized and positioned rivet of that location. The image processing system includes two cameras, shown in FIG. 4, aimed at the rivet fingers 74 of the fastener holder 76 for acquiring images of the rivet in the rivet fingers, and a back light opposite each camera on the other side of the rivet fingers to backlight the rivet.

The cameras include a side view camera 80 and an oblique view cameras 82 mounted at 35° from the "Y" axis on an angle bracket 84 which in turn is connected to an upright support bar 86. The support bar 86 is removably connected to a mounting knuckle 88 by way of a cylindrical tenon 90 which fits into a cylindrical opening 92 in the knuckle 88 and is held in a vertical position by a key slot 94 on the cylindrical tendon 90 which mates with a key 96 in the cylindrical opening in the knuckle 88. The knuckle 88 is slit at 98 and has a handle 100 which can be turned to close the slit 98 to grip the cylindrical tendon 90 tightly in the opening 92 and the knuckle 88.

Figure 9:
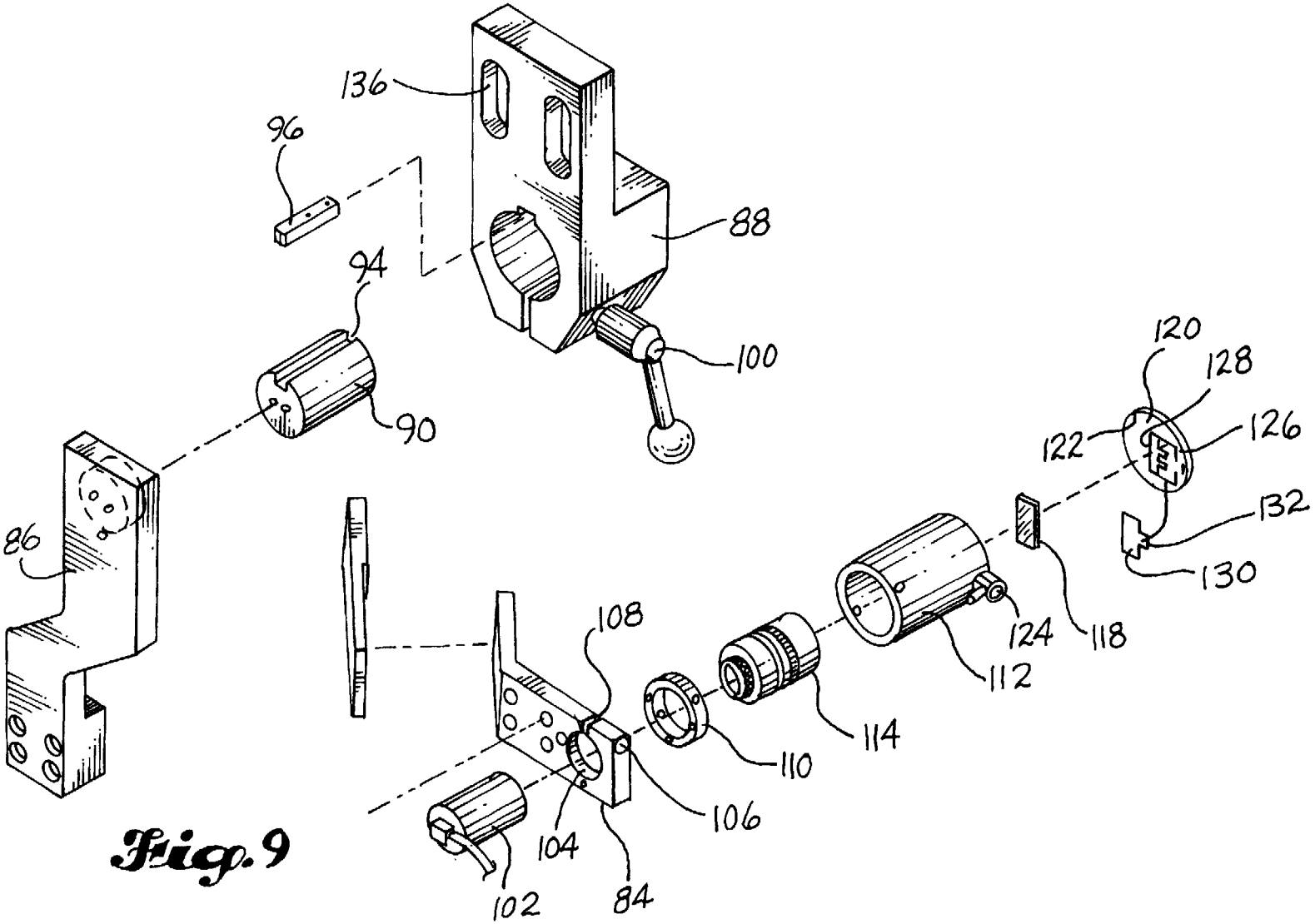
FIG. 9 is an exploded view of the camera and camera support and mounting brackets shown in FIG. 7.

The two cameras 80 and 82 are identical so that description of the camera 80 will also apply to the camera 82. The camera 80, shown exploded in FIG. 9, includes a scanning video camera 102 such as model CV-31SH made by Motion Analysis Company. Naturally, other cameras could be used and in fact have been used in this application. The camera 102 is held in a cylindrical opening 104 and is gripped therein by squeezing closed a slit 108 through the edge of the angle bracket 84 with a screw 106 which tightens the opening 104 around the camera 102. A camera support ring 110 is fastened to the face of the bracket 84 coaxially around the opening 104 and is connected by screws or the like to a cylindrical housing 112 which encloses and protects a lens such as a 6 millimeter SNX 612 lens from Tamron Company. The lens 114 is screwed into the video camera 102 in the usual manner.

A protective cover disk 120 is connected to the front end of the cylindrical housing 112 with screws extending through holes 122 in the disk 120 and threaded into holes drilled into the edge of the cylindrical wall of the housing 112. A fitting 124 for connection to a flexible air tube (not shown) is screwed into the side of the housing 112 adjacent the front end thereof communicating with the front end of the housing by way of an axial hole drilled into the edge of the cylindrical wall of the housing 112 that intersects the hole into which the fitting 124 is threaded.

The disk 120 has a stepped recess 126 which extends from a rectangular opening 128 through the center of the disk 120 to a necked down portion adjacent one edge of the disk 120. A cover plate 130 is seated in the stepped edges of the recess 126 and is supported on the center portion adjacent the rectangular opening 128 by two ribs. A hole 132 in the necked down portion of the cover plate 130 aligns with the axially hole in the housing 112 that communicates with the fitting 124, so that air delivered to the fitting 124 passes through the hole 132 and into the recess 126 behind the cover plate 130 to blow air into the opening 128. In this way, a steady stream of clean air blows outwardly through the opening 128 to prevent ingress of airborne contaminants such as drilled chips and lubricants.

A glass plate 118 is glued over the opening 128 and, together with the disk 120 provides a sealed enclosure for the lens 114. The glass plate 118 is made of filter glass which passes only light in the near infrared spectrum produced by the back lights.

Figure 10:
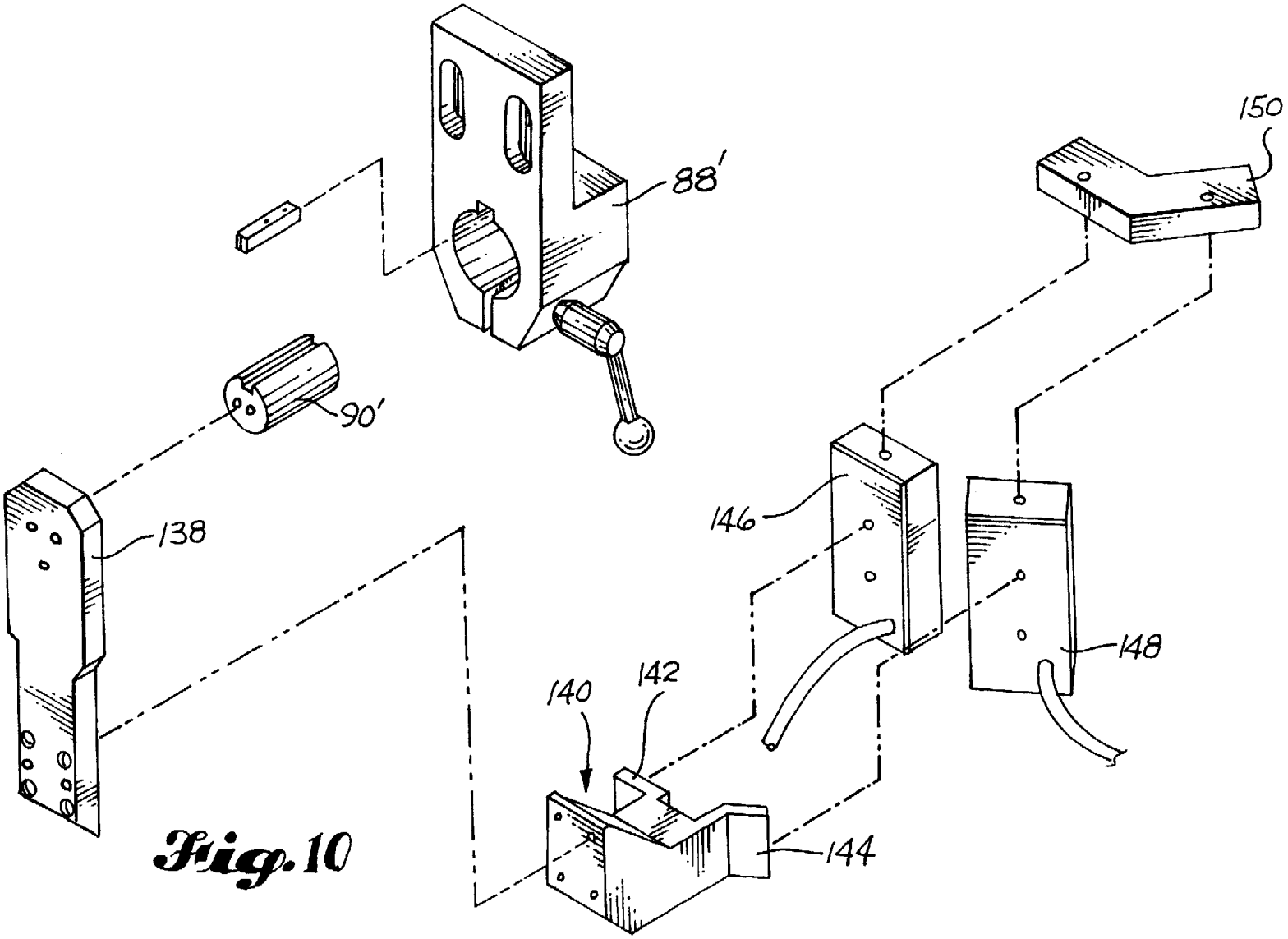
FIG. 10 is an exploded view of the lights and light support and mounting brackets shown in FIG. 8.

As shown in FIG. 10, the back lights include two back light units 146 and 148 mounted on a straight flange 142 and an oblique flange 144 of a transition bracket 140. The transition bracket 140 is connected by screws or the like to a vertical light bracket removably connected to a support knuckle 88' by a cylindrical tenon 90', identical to the corresponding structure 88 and 90 used to support the cameras 80 and 82. The knuckles 88 and 88' are each connected through elongated holes 136 to the transfer box. An identical pair of support knuckles (not shown) is attached to the transfer box in a position spaced away from the rivet injector 68 to provide a convenient mount to which the lights and cameras may be removed when the area around the rivet injector must be cleared for service or for changing components of the machine.

Figure 12:
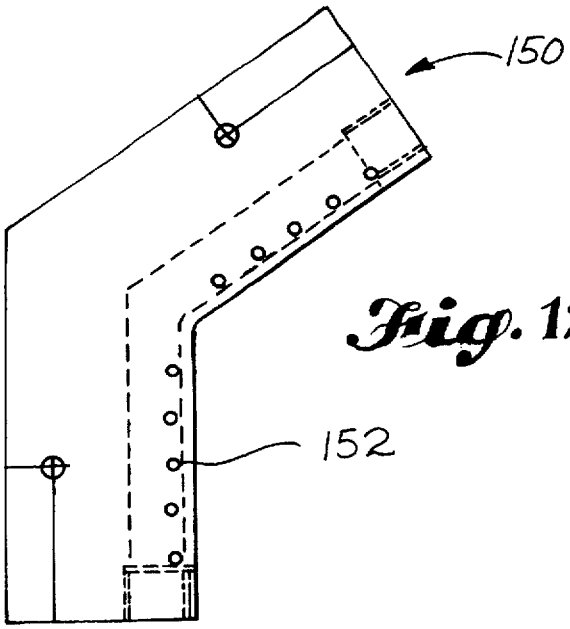
FIG. 12 is a plan view of the light assembly shown in FIG. 11.
Figure 11:
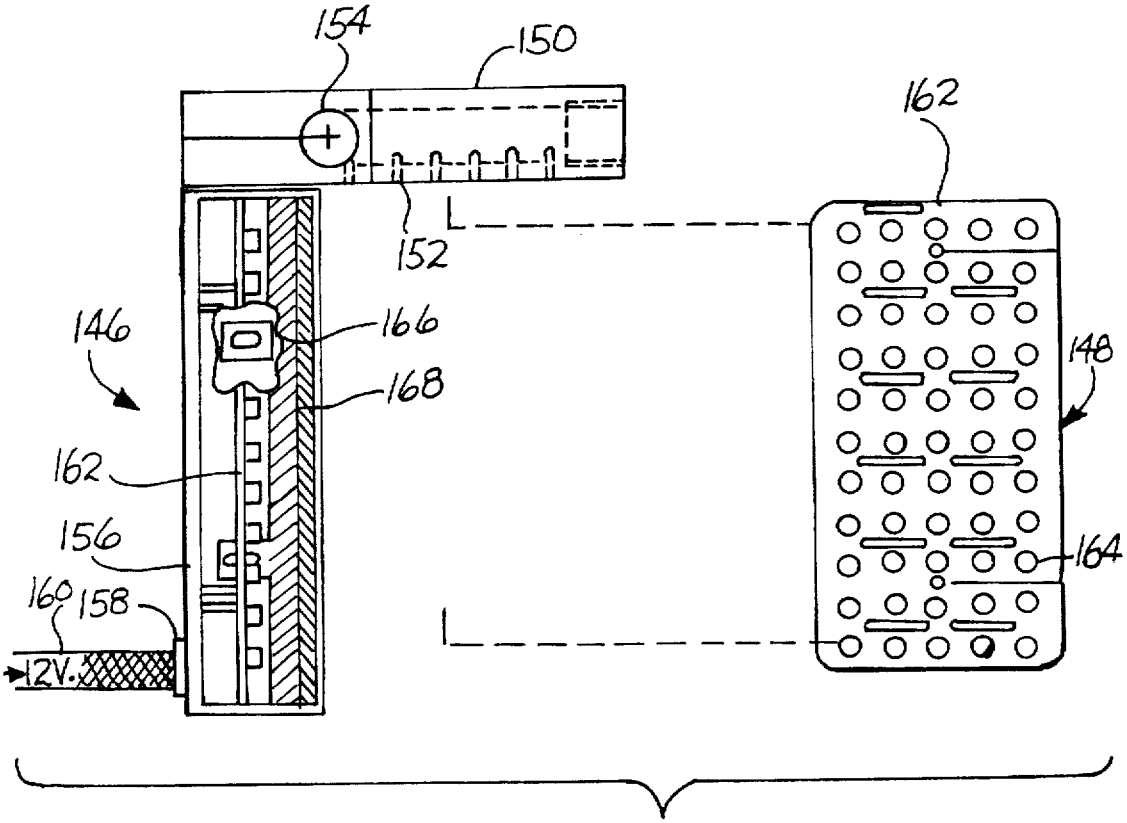
FIG. 11 is an elevation of the light assembly (without the mounting brackets) shown in FIG. 10.
Figure 13:
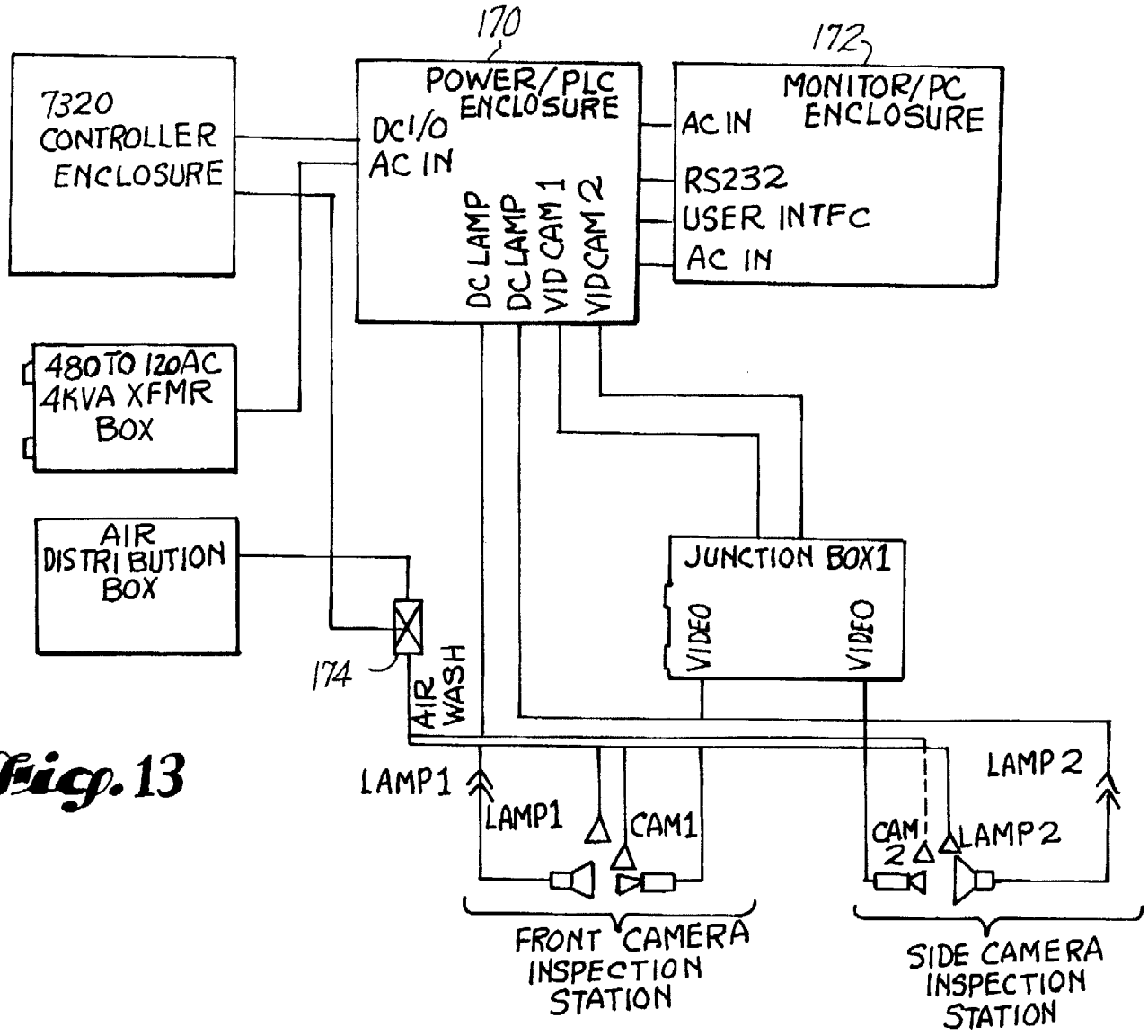
FIG. 13 is a system schematic diagram of the control system for the fastener inspection system of this invention.

An air knife 150 is attached to the top of the light units 146 and 148 as shown in FIGS. 10 and 11 to create an air curtain in front of the light units to militate against deposits of lubricants and debris from the machine operation, such as drill chip fragments. The air knife structure, shown in FIG. 12, is an angled air plenum having a series of vertical holes drilled adjacent the under side of the front edge to direct a downwardly flowing curtain of air in front of the back lights 146 and 148. The air knife has an opening 154 for attachment of an air hose coupling for delivery of clean air to the air knife.

The light units 146 and 148 are identical, so a description of one will serve for both. The light unit 146 includes a housing 156 having a cable connector 158 by which an electrical cable 160 for delivery of electrical power at 12 volts to the light unit 146. A perforated board 162 is mounted in the housing 156 and 55 light emitting diodes 164 are mounted in the perforations. A diffuser 166 is placed over the diodes 164 and is covered with a scratch resistant glass plate 168.

The control system for the invention includes an Allen-Bradley PLC-5 programmable controller in an enclosure 170, and a personal computer and monitor in an enclosure 172, communicating with an existing Allen-Bradley 7320 controller that controls the operation of the machine 30. The enclosure 170 also contains suitable AC and DC power supplies, circuit breakers and appropriate terminal blocks for connection to field devices and other systems. The personal computer is an IBM compatible unit communicating with the PLC-5 through an RS-232 port. The PC includes image processing boards available from Cognex Company.

In operation, the automatic fastener installation machine is triggered by the Allen-Bradley 7320 controller to move to a new rivet location position. While the machine is moving, the 7320 controller sends a signal to the PLC-5 informing it of the fastener to be installed at the new location. The code informs the PLC-5 of the length and diameter of the fastener to be installed. While the machine is moving, the tool shuttle 46 moves to the left in FIG. 2 to position the fingers 74 of the rivet holder adjacent the rivet injector 68. A rivet is escaped from the temporary storage mechanism and forced by compressed air through the tube 70 into the rivet injector, and the pneumatic cylinder is pressurized by a signal from the 7320 controller to feed a rivet to the rivet fingers. On retraction of the ram in the rivet injector 68 a signal is transmitted from the 7320 controller to the PLC-5, and 200 milliseconds later the PLC-5 triggers the image processing system cards in the PC to acquire an image from both the side view camera 80 and the oblique view camera 82.

Figure 14:
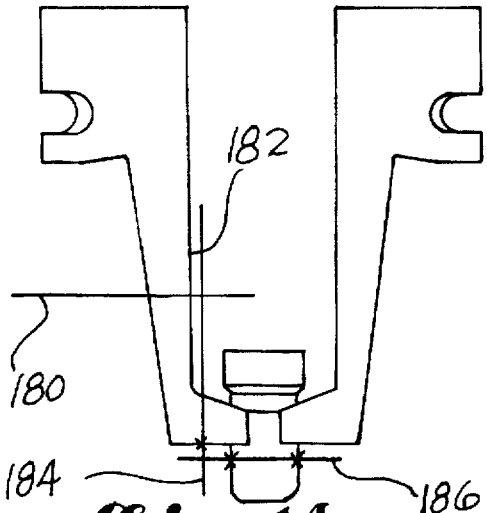
Figure 15:
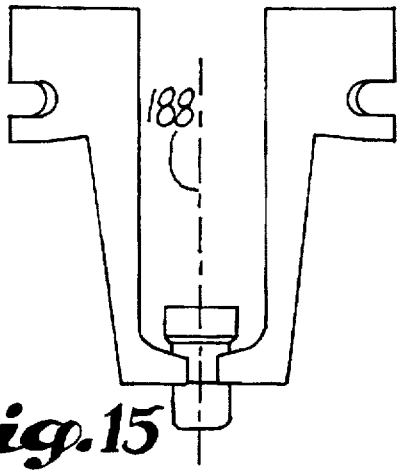

The image processing system uses edge detection tools to locate the position of the rivet fingers 74 in the image. The edge detection tools include reference tools to place the actual measurement tools of the image processing system vertically and horizontally in position to locate the position of the fastener with respect to the rivet fingers 74. This allows some flexibility of movement of the fingers with respect to the camera since fingers of various sizes are used for placing different size rivets. The reference tools scan a horizontal line 180 positioned to intercept the left rivet finger 74L, shown in FIG. 14, and finds the right edge 182 of the finger 74L using grayscale values which are exaggerated by the silhouette character of the image created by the backlite rivet fingers 74. The image processor then counts several pixels to the right and establishes a vertical reference line 184 which it scans down to find the lower edge of the rivet finger 74L. The image processor counts several more pixels down and establishes a lower reference line 186 which is used to find the center of the rivet held in the fingers 74 to establish a centerline gage 188 for measuring the rivet length, and for positioning a series of line gages shown in FIGS. 16 and 18–20 for determining rivet diameter, whether stacked rivets are present, and whether the rivet is held in an inverted or cocked position.

The image from the oblique view camera 82, shown in FIGS. 14–17, is processed to determine the length, diameter, status, inverted status, missing status and held by the head status of the rivet. To determine the length, the centerline gage 188 is placed vertically along the center line of the rivet. The image system examines the pixel values recorded along the center line of the rivet and detects the top and bottom edges by changes in the grayscale value. Because of the back lighting of the rivet, the brightest part of the image will have a pixel value near maximum and a pixel value of zero at the black part of the image where the rivet is blocking the back light. There is typically a gradual change in grade scale values and the image system performs a first derivative looking for the place the pixel value drops from a lighter value to a darker value. The apparent position of the edge transition can be determined to a high degree of accuracy by doing a center of mass calculation which gives a value that is resolved to a subpixel position or a non-quantitized decimal instead of a whole number. This is well within the accuracy requirements of the application in which rivet dimensions vary by about one sixteenth inch, so the length and diameter measurements are easily correlated to the various rivets sizes which are used in a typical structure. If an intermediate size is detected it is identified as a mis-sized rivet and is rejected just as any other mis-sized rivet would be.

Since the edge tool provides the rivet length in pixels and calibration has established the height of the pixel in inches, it is simple multiplication to determine the actual rivet length. The measured length is then checked against the expected length and, if the measure length is outside of the tolerance limits or rivet expected at that location, the image processor triggers a "wrong length" message to be issued by the PC, the machine is interrupted, and the true length of the rivet is provided on a display to the operator and is logged on the log file.

To determine the diameter of the rivet, a series of edge tools is placed horizontally across the rivet at regular intervals along the length of the rivet. Starting from one side, the edge tool reports its edge transition points along the length of the edge tool. The first two transition points are used to detect the diameter of the rivet body if it hangs down far enough below the fingers. This measured diameter is compared to the expected diameter that was defined in the rivet date provided by the 7320 controller. If the diameter exceeds predetermined limits, the machine operation is interrupted, the operator is notified of the "wrong diameter" and the error is logged to the log file.

Figure 16:
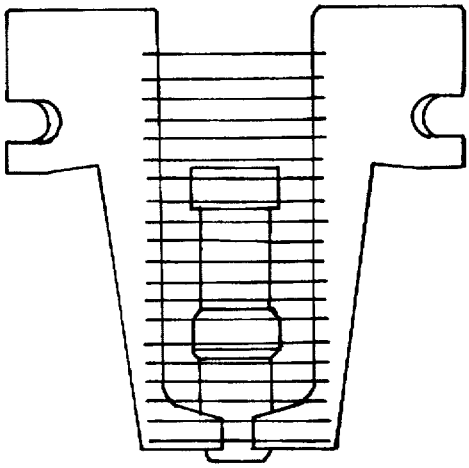

To determine if two stacked rivets are present, as shown in FIG. 16, the vertical edge tool information is checked for length. If the length of the rivet exceeds 1.5 times the expected length for the rivets specified in the information provided by the 7320 controller, the image processor generates a signal which is sent to the 7320 controller to interrupt the operation of the machine process, a "stacked rivet" notice is sent to the operators monitor, and the error is logged to the log file.

Figure 17:
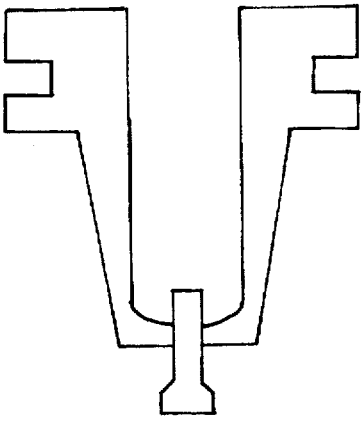
FIGS. 14–17 show side elevation images made by the side camera shown in FIG. 4 of rivets in a fastener holder in various positions in which the rivet can be held.

Inverted rivets, shown in FIG. 17, are detected by comparing the edge data from a horizontal gauge lines above and below the gripping point of the fingers. The diameter of the rivet, that is the diameter of the shank below the head, is known from the data provided by the 7320 controller, so if the edge tools report a valid body diameter above the location at which the edge tool reports the rivet head diameter, the image processor declares the rivet "upside down", interrupts the machine cycle, notifies the operator and logs the error to the-log file.

The image processor identifies missing rivets by the fact that none of the horizontal or vertical tools present edge transition data where a rivet is expected and the results that are presented are consistent with blank rivet fingers.

The image processor identifies rivets held by the head by measuring the distance from the top of the rivet using the vertical edge tool, to the bottom of the fingers identified by the location of the vertical finger reference gauge 182. If that distance is smaller than a predetermined limit, the rivet is declared "held by the head," the machine cycle is interrupted and the operator is notified.

Figures 18, 19, 20:
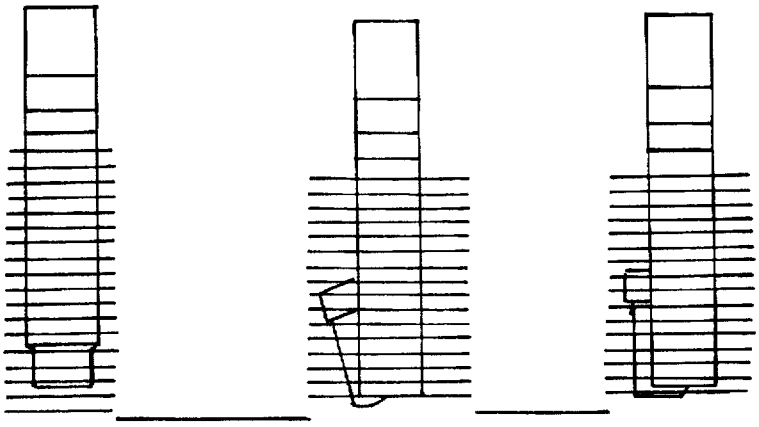
FIGS. 18–20 show oblique angle elevation images made by the oblique angle camera shown in FIG. 4 of rivets in offset, cocked and straight positions, respectively.

The image created by the side view camera 80, shown in FIGS. 18–20 is used to determine the tipped status of the rivets. The image processor detects edge transitions in a tipped rivet image by comparing a series of adjacent edges and adjacent horizontal edged tools and when it detects that there is a series of edges detected along these edged tools that are not vertically aligned, that is, produce values from the vertical centerline through the fingers 74, and that the edges do not protrude beyond the rivet fingers an equal amount on both sides, a tipped rivet is identified. The image processor generates an error signal that interrupts the machine cycle and a "tipped rivet" message is displayed to the operator on the monitor. An image of the tipped rivet in the fingers is displayed and recorded on the image record system.

When a rivet error is detected by the image processing system, the machine cycle is halted and the operator is informed of the problem and can see, in real time, the image of the rivet in the fingers both from the side and from oblique angle. If the operator concludes that it is an error, he can, with his hand controller, trigger the injection of a new rivet by the rivet injector into the fingers 74, which displaces the rivet already held between the fingers. Assuming that the new rivet is the right size and correctly oriented in the fingers, the machine cycle proceeds automatically to drill the hole, shift the tool shuttle 46 to position the ram and rivet holder vertically above the newly drilled hole, and inserts the rivet into the hole using the anvil 78 at the lower end of the rim 48 to push the rivet into the hole.

Obviously, numerous modifications and variations of the disclosed embodiment will occur to those skilled in the art upon reading this description. Accordingly, it is expressly to be understood that these modifications and variations, and the equivalents thereof, may be practiced while remaining within the spirit and scope of the invention, wherein we claim:

We claim:

1. A process for verifying proper fastener size and position in an automated fastener installation machine, comprising:

feeding a fastener from a fastener feed device to a fastener holder of a fastener insert device of an automated fastener installation machine;

holding said fastener in said fastener holder while creating an image of said fastener with a vision system;

comparing said fastener image with a set of stored data to confirm that the fastener fed to said fastener insert device is correctly positioned and is of the correct length and diameter; and inserting said fastener into a hole and securing said fastener.

2. A process as defined in claim 1, further comprising:

back lighting said fastener and said holder with back lights while creating said image to enhance the clarity of said image and minimize disruptive effects of background clutter.

3. A process as defined in claim 2, further comprising:

arranging a blank diffuser between said back lights and said fastener while creating said image to enhance the clarity of said image and minimize disruptive effects of background clutter.

4. A process as defined in claim 3, further comprising:

blowing clean air from said back lights around said diffuser to prevent contamination of said diffuser by lubricant and drill chips from said fastener installation machine.

5. A process as defined in claim 1, wherein:

said image creating step includes scanning said fastener and said holder with a camera of a vision system while blowing clean air around a lens of said camera to prevent contamination of said lens by lubricant and drill chips from the vicinity of said fastener installation machine.

6. A process as defined in claim 1, further comprising:

halting operation of said automatic fastener installation machine upon detection of an incorrectly oriented or wrong sized fastener in said fastener holder, and restarting operation thereof only after input of a restart signal from an operator.

7. A process as defined in claim 1, further comprising:

removing any fastener that is improperly oriented and/or sized from said fastener holder and refeeding another fastener to said holder.

8. A process as defined in claim 7, wherein:

said removing step includes feeding a properly sized fastener into said fastener holder to displace said any fastener that is improperly oriented and/or sized in said fastener holder.

9. An apparatus for feeding a fastener to a fastener inserter in an automatic fastener installation machine, sensing the orientation and size of the fastener in the fastener inserter to determine whether the fastener is properly sized and properly oriented in the fastener inserter, and inserting the fastener into a hole in a work piece, comprising:

a support structure for holding said work piece in juxtaposition to said fastener inserter;

a fastener feeder for delivering a fastener to a fastener holder, said fastener holder being biased to hold said fastener and to release said fastener when said fastener is pressed into a hole in said work piece; and an image processor system for creating an image of said fastener in said fastener holder and for comparing predetermined points in said image with corresponding predetermined points that would be produced by said image processor system of an image of a properly sized and oriented fastener in said fastener holder, and for producing a signal for said automatic fastener installation machine to proceed with its cycle when it detects that a fastener of the correct size is positioned correctly in said fastener holder.

10. An apparatus as defined in claim 9, wherein:

said image processor system includes two cameras aimed at said fastener holder from different angles.

11. An apparatus as defined in claim 10 further comprising:

a protective transparent cover across the front end of each camera, and an air nozzle in each camera positioned to blow clean air across said protective transparent cover to prevent lubricants and chips from said automatic fastener installation machine from being deposited on said protective transparent cover.

12. An apparatus as defined in claim 10, further comprising:

a back light positioned in the direction of aim of each of said cameras on the opposite side of said fastener holder, whereby said image of said fastener is in the nature of a silhouette against said back light.

13. An apparatus as defined in claim 12, further comprising:

a protective transparent cover across the front end of each of said cameras, including a glass plate made of light filter material that passes primarily only the spectrum of said back light.

14. An apparatus as defined in claim 12, wherein:

said back light produces light predominantly in the spectrum of optimum sensitivity of said camera.

15. An apparatus as defined in claim 12, wherein said back light includes:

a light housing containing a source of light, and a blank diffuser covering a front face of said light housing facing said camera.

16. An apparatus as defined in claim 15, wherein:

said light source produces light in a near infrared spectrum, which is the spectrum of optimum sensitivity of said camera.

17. An apparatus as defined in claim 15, further comprising:

an air nozzle adjacent each diffuser, said air nozzle having a coupling for connection to a source of clean air, whereby a curtain of clean air can be blown across said diffuser to militate against the deposition of airborne contaminants from said automatic fastener installation machine on said diffuser.

18. An apparatus as defined in claim 10, wherein:

said image processor system detects edges of said fastener in said fastener holder and calculates length and diameter dimensions of said fastener, then compares said length and diameter dimensions against certain predetermined dimensions and produces an error signal when dimensions outside of said predetermined dimensions are detected.

19. An apparatus as defined in claim 10, wherein said image processor system includes:

a camera aimed at a side of said fastener holder for producing an edge image of said fastener in said holder; and an image processor for detecting edges of said fastener in said fastener holder and comparing horizontal distance from a series of edges on adjacent horizontal edge tools to a vertical reference line gage, and producing an error signal when a series of edges is detected along said edge tools that are not vertically aligned.

20. An apparatus as defined in claim 10, wherein said image processor system includes:

a camera aimed at said fastener holder for producing an image of said fastener in said fastener holder that shows said fastener and two fingers of said fastener holder; and an image processor for detecting edges of said fastener in said fastener holder and for comparing edge data along horizontal gauge lines with data from valid fastener files, and producing an "upside down" error signal when said edge tools report a valid body diameter above the location at which said edge tool reports a rivet head diameter.

21. An apparatus as defined in claim 10 wherein said image processor system includes:

a camera aimed at said fastener holder for producing an image of said fastener in said holder that shows said fastener and two fingers of said holder; and an image processor for detecting edges of said fastener in said fastener holder and for comparing edge data along horizontal gauge lines with data from valid fastener files, and producing a "missing fastener" error signal when none of the horizontal or vertical tools present edge transition data where a fastener is expected.

22. A process for verifying proper fastener size and position in an automated fastening machine, comprising:

injecting a fastener into a fastener holder and inspecting the fastener during the time that the machine is moving to the next fastener insert position;

detecting the positions of edges of said fastener in said fastener holder with an image processor system which generates pixels corresponding to the positions of the edges of said fastener;

converting numbers of the pixels between said edges into dimensions to determine measured fastener dimensions;

comparing said measured fastener dimensions with dimensions of correctly sized fasteners designed for the particular position in which said fastener is to be inserted; and producing an error signal that stops said machine when said measured fastener dimensions deviate from said dimensions of a correctly sized fastener by more than a predetermined value.

* * * * *